United States Patent [19]

Kalinowski

[11] 3,996,755

[45] Dec. 14, 1976

[54] TENSION LEG STRUCTURE WITH RISER STABILIZATION

[75] Inventor: David W. Kalinowski, Metairie, La.

[73] Assignee: Texaco Exploration Canada Ltd., Calgary, Canada

[22] Filed: July 10, 1975

[21] Appl. No.: 594,922

[52] U.S. Cl. ..... 61/86; 114/.5 D; 166/.5; 175/7

[51] Int. Cl.[2] ..... E02B 17/00

[58] Field of Search ..... 61/46.5, 46; 114/.5 D; 175/7; 166/.5

[56] References Cited

UNITED STATES PATENTS

| | | | |
|---|---|---|---|
| 3,572,272 | 3/1971 | Dixon et al. | 114/.5 D |
| 3,654,886 | 4/1972 | Silverman | 61/46.5 |
| 3,817,325 | 6/1974 | Mott et al. | 166/.5 |
| 3,902,843 | 9/1975 | Genini et al. | 61/46.5 |

FOREIGN PATENTS OR APPLICATIONS

| | | | |
|---|---|---|---|
| 188,414 | 12/1966 | U.S.S.R. | 61/46.5 |

*Primary Examiner*—Paul R. Gilliam
*Assistant Examiner*—A. Grosz
*Attorney, Agent, or Firm*—T. H. Whaley; C. G. Ries; Robert B. Burns

[57] ABSTRACT

A tension leg marine structure or working platform which is floatably positioned above an offshore working site, being maintained in place by a plurality of tension cables that connect to anchors at the sea floor. A riser which extends between the structure and the sea floor is laterally supported by a bracing system adapted to adjust to the platform's movement and conditions, thereby to stabilize strain applied to the riser.

5 Claims, 6 Drawing Figures

FIG. 3
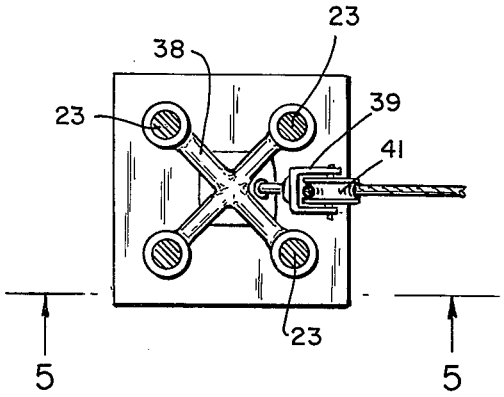
FIG. 4
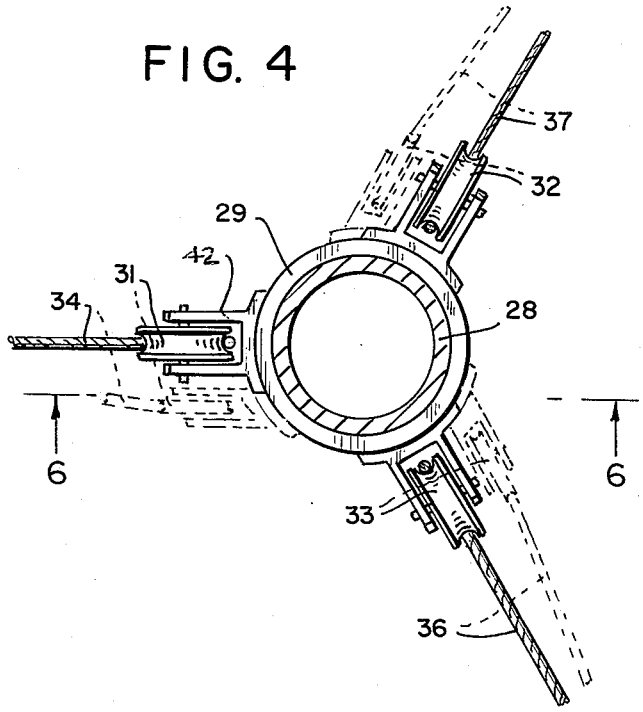
FIG. 5
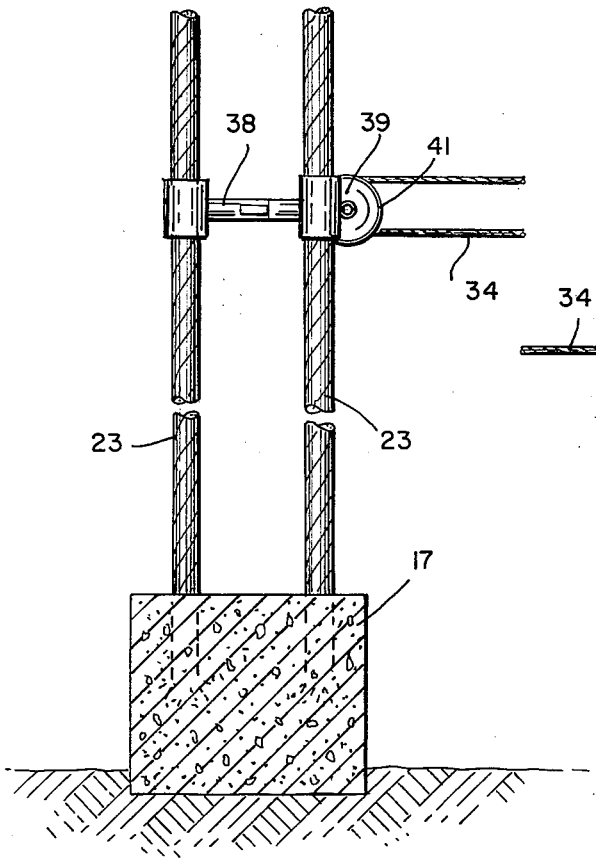
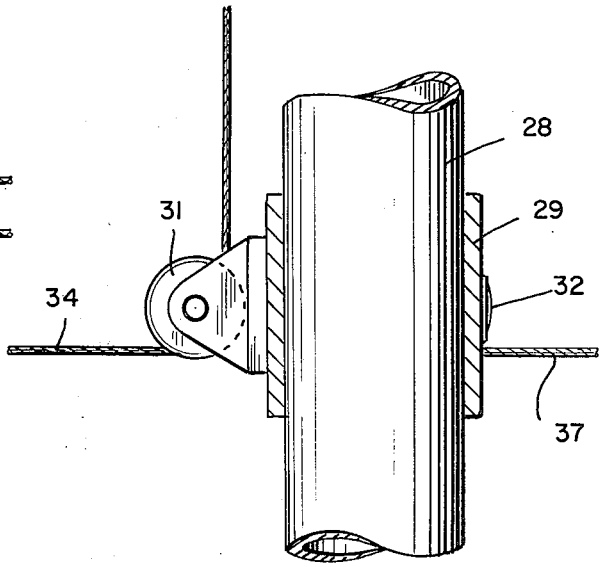
FIG. 6

TENSION LEG STRUCTURE WITH RISER STABILIZATION

BACKGROUND OF THE INVENTION

In the exploration and drilling for offshore oil and gas wells, one form of marine structure found to be desirable and effective is the tension leg platform. In this type unit, the working structure is floatably supported by its own buoyancy. However, tension cables applied to the lower end of the platform and fixed to the ocean floor, allow it to be drawn downwardly to a desired working depth.

Under such conditions the structure is less amenable to natural forces such as wind and waves which would otherwise tend to displace and disturb the horizontal orientation of the platform with respect to the ocean floor.

In the drilling of offshore wells, it is necessary to utilize a riser, often referred to as a marine riser, which extends from the well head to the working deck of the floating platform. The riser member is in effect an elongated enclosure which surrounds and protects the drill string as well as pipes which pass from the well upwardly to the platform deck.

Such risers are necessary for normal drilling operations but are susceptible to damage and in many cases to breakage. The latter results from excessive strain applied to the riser as the floating platform vacillates about its working position in response to excessive wind and wave conditions at the water's surface.

Further, the riser is subjected to a considerable stress induced by water currents and the like which pass around the riser, but which are not particularly effective against the platform. In such an instance the normally vertical riser disposition tends to be distorted as the latter is displaced laterally in one or more directions in response to underwater currents.

In the presently disclosed arrangement, the elongated riser of the type contemplated is provided with means directly attached to the tension leg platform such that the disposition and distortion of the riser is readily controlled. The control means includes a flexible connection which extends from the centrally placed riser, outwardly toward the respective tension or hold down cables. Thus, as the riser is subjected to deflecting forces the flexible connection will tend to dampen such movement thus precluding the build-up of excessive local strains.

It is therefore an object of the invention to provide means for supporting a marine riser from a floating tension leg platform positioned at an offshore body of water. A further object is to avoid damage to such a marine riser which would occur if the riser were to be excessively stressed as a result of underwater currents and forces acting thereagainst. Another objective is to provide means for regulating the disposition and alignment of a marine riser through suitable adjustment thereof in a controlled manner from the deck of the floating platform.

Toward achieving the above objectives and toward overcoming the herein mentioned problems, the invention is directed to a bracing system adapted to cooperate with a floating, tension leg type marine structure. The system forms a flexible interconnection between the structure and the marine riser. The riser bracing system includes compensating means for automatically regulating the resisting forces applied to a riser as the latter is deflected from its desired upright disposition.

DESCRIPTION OF THE DRAWINGS

FIG. 3 is a cross sectional view taken along line 3—3 in FIG. 1.

FIG. 4 is an enlarged cross sectional view taken along line 4—4 in FIG. 1.

FIG. 5 is a segmentary view on an enlarged scale of the platform anchor member shown in FIG. 1.

FIG. 6 is an enlarged segmentary view taken along line 6—6 in FIG. 4. Referring to FIG. 1, a floating tension leg platform 10 or marine structure of the type contemplated is found to be both practical and desirable for offshore drilling, exploratory and storage work. The platform embodies the advantage of being less susceptible to disruptive forces caused by wind and surface wave conditions, thus assuring continuous drilling operations in spite of the weather.

Figure 1:
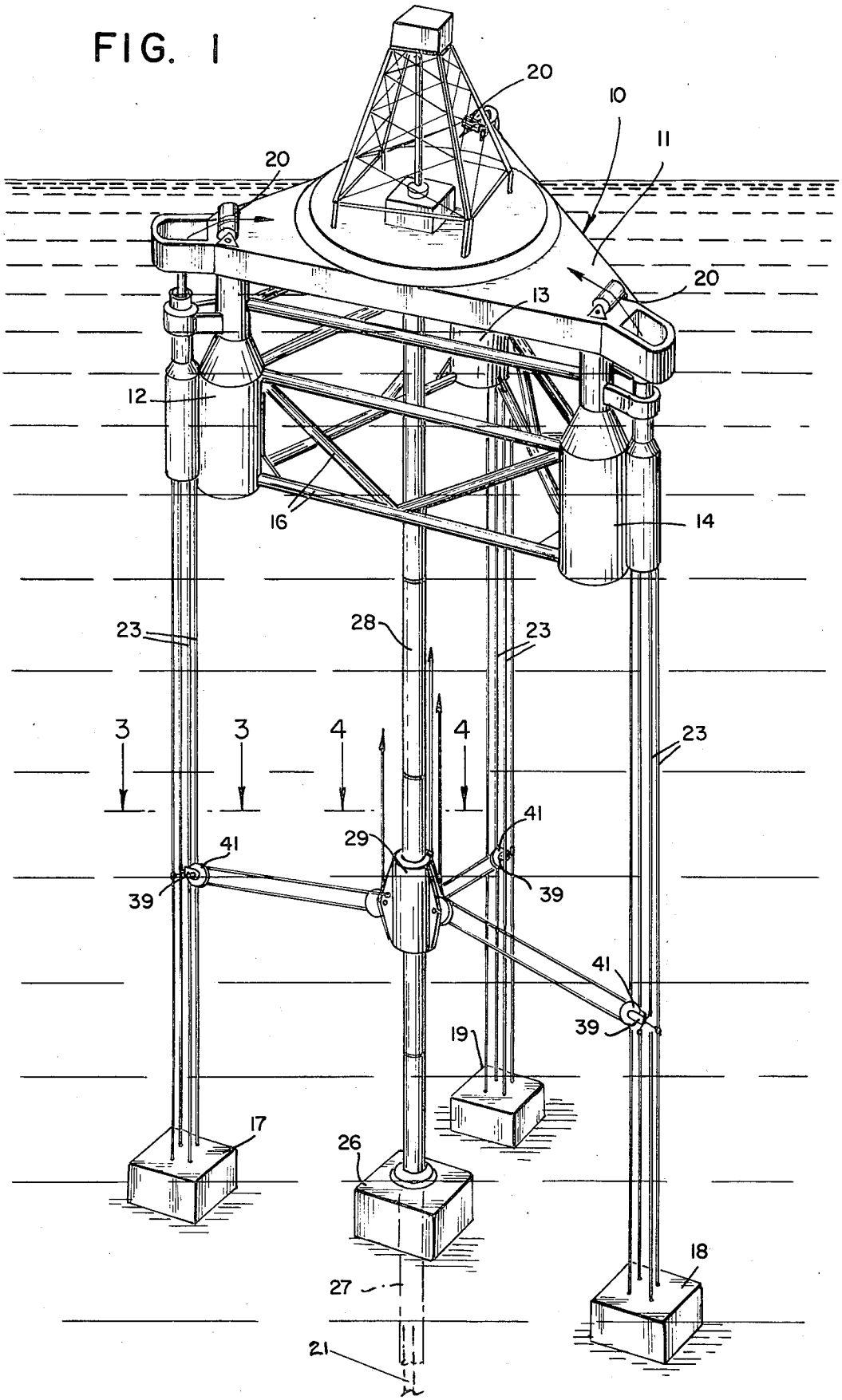
FIG. 1 is an elevation view of the present offshore platform shown in the submerged postion being anchored to the ocean floor.

Functionally, platform 10 includes a working deck 11 which is normally positioned 50 to 60 feet above the water's surface. A plurality of downwardly extending controllably buoyant members of legs 12, 13 and 14 are supportably connected at their upper ends to the deck 11 thereby maintaining the unit at a desired level in the water. The respective buoyant members are normally of sufficient tank capacity that deck 11 can be raised or lowered as desired through the use of a suitable control system, for either transporting the structure, or for positoning it at a working site.

While not shown in detail, the respective buoyant members are further provided with cross bars 16 and other necessary understructure to rigidize the unit.

To provide the necessary stability, a plurality of anchors 17, 18 and 19, normally a minimum of three, are disposed at the ocean floor about the site where a well 21 is to be drilled. These anchors are preferably positioned to be directly beneath the platform 10 and are arranged peripherally about the proposed well head.

Each anchor, such as 17, is firmly embedded into the ocean floor by piling in the usual manner. However, if the anchor is of sufficient weight it can maintain its position in spite of upward forces acting thereagainst.

Anchor 17 is provided at its upper surface with cable holding rings or the like such as cable directing members or pulleys through which a hold down cable 23 is wound. In any instance anchor 17 is adapted to receive a plurality of the tension members 23 which can be in the form of individual steel cables. The latter of course extend through the water between the anchor 17 and floating structure 10.

As mentioned, each floor positioned anchor is preferably provided with a plurality of the hold down cables 23. In the instant embodiment, at least four are shown extending from each anchor 17, upwardly to deck 11. The respective cable ends are connected to a cable take-up mechanism 20 on deck 11, which is adapted to adjust the cable tension and thus regulate the floating position of the structure. Ideally, the cables should extend in a substantially vertical direction between their upper and lower points of connection. While this disposition is preferred, its absence would not preclude use of the present riser control system. For example, the respective cables 23 can be canted to one side by displacement of the platform, or the anchors, and still serve the function for which they were designed.

Functionally, and prior to a well drilling operation, at such time as marine structure 10 is positioned above a drilling site it is buoyed to a desired level by regulation of the respective legs 12, 13 and 14. Thereafter, the respective cables 23 are attached to preplaced anchors 17, 18 and 19 at the ocean floor, and are reeled in or tensioned such that platform 10 is uniformly drawn deeper into the water although being buoyed upwardly by the same forces applied through the respective legs. At a predetermined working depth, the cable tensioning operation is terminated.

Figure 2:
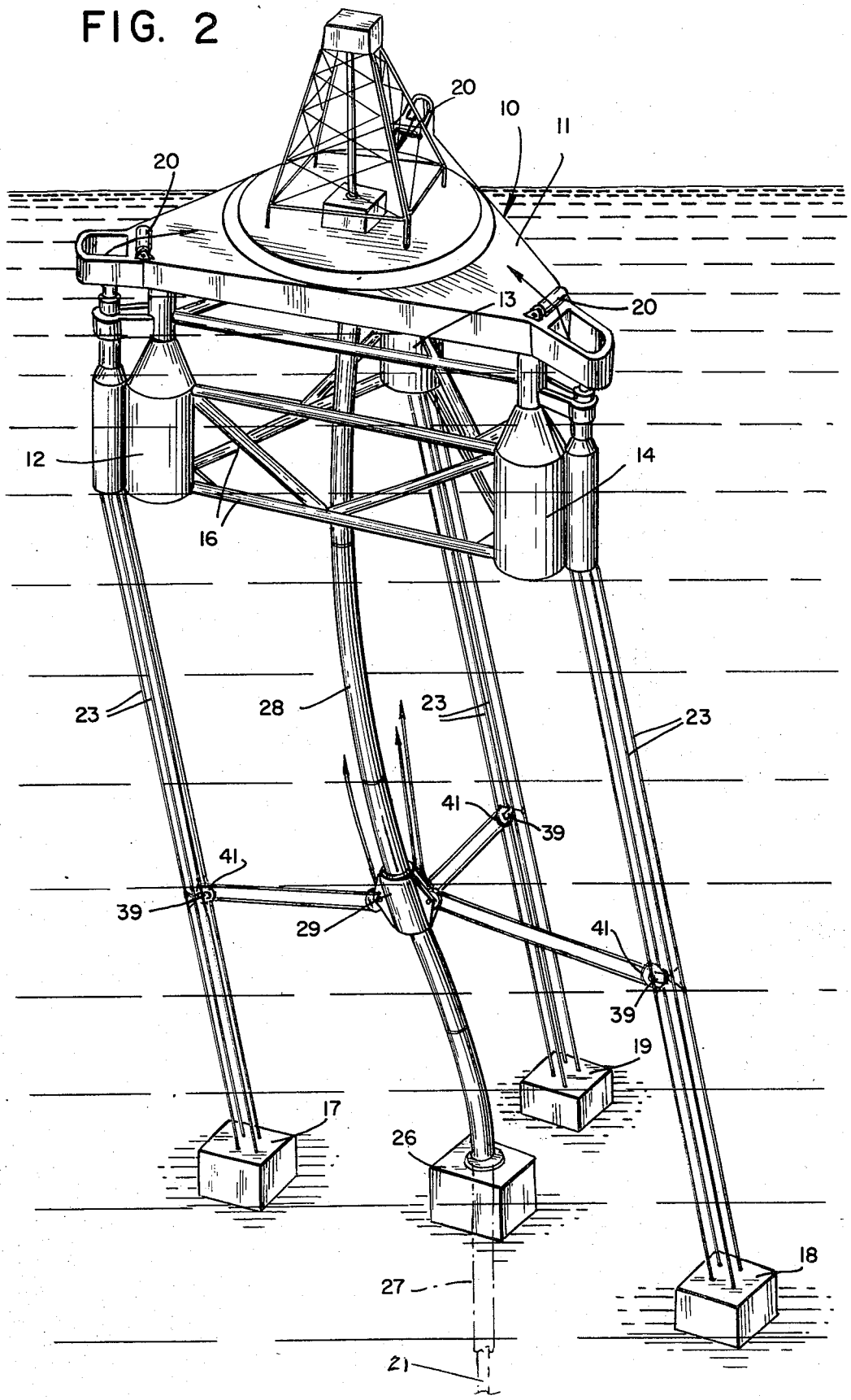
FIG. 2 is an alternate illustration of FIG. 1 showing the platform in a displaced position.

As presently positioned, and referring to FIG. 2, platform or structure 10 is in effect tethered such that it can experience limited horizontal movement. Such movement will embody a degree of vertical displacement. Thus, when subjected to a displacing force, the floating structure will be moved laterally in an amount permitted by restraining cables 23, and contingent on the platform's buoying force.

Normally, after platform 10 is positioned at a working site, the basic well head equipment is installed. The latter is preferably embedded beneath the marine structure 10 such that a drill string, supported from platform deck 11, can be readily inserted and reinserted into the well head for a drilling operation. As presently shown, the normal well head equipment includes a base member 26 through which a number of casing members 27 are passed and supported. The usual Christmas tree arrangement and control member, although not shown, are also included in the base to regulate the drilling operation insofar as fluid flow is concerned.

Base 26 is further provided with a suitable connector adapted to operably engage the lower end of a drilling riser 28 at a removable connector coupling.

Riser member 28 comprises an elongated tubular unit of sufficient diameter to permit at least a drill string to pass downwardly therethrough and to conduct drilling fluid from the well to the platform deck 11. Normally riser 28 is fabricated of a series of short tubular steel members which are end welded or bolted during installation to form a single continuous length. The riser is terminally fastened in such manner at both the well head and at the drilling deck 11, such that a drill string is readily inserted thereinto to perform a drilling operation.

As presently shown, the lower end of riser 28 is pivotally connected at the well head to allow a limited amount of relative movement therebetween as platform 10 is displaced from its desired location above the well head.

As herein mentioned, a considerable amount of difficulty has been experienced with floating offshore structures of the type contemplated particularly in the use of such structures in deep water. Notably, such difficulties are prompted when platform 10 is displaced excessively, or when it is subjected to extreme movement due to weather conditions on the water's surface. Thus, and as herein noted, riser 28 is susceptible to both damage and to breakage.

To lessen the strain on riser 28 during a drilling operation, a riser tensioning system is employed. The latter includes primarily means for connecting centrally positioned riser 28 to the respective tensioning cables 23, located radially therefrom. The respective cables will thus function to resist movement of the riser in such manner to absorb any sudden shock or excessive stress which might otherwise be imposed.

As shown in FIGS. 1 and 4, riser 28 is provided with a collar or ring 29 which firmly engages and encircles the riser periphery. While but a single ring 29 is presently shown, it is understood that a series of such rings, or even appropriate fastening lugs, can be applied to the riser 28 exterior during its placement period such that the riser tensioning system will act along a series of longitudinally spaced stabilizing levels.

Ring 29 is provided with a pulley system including circumferentially spaced, rotatably mounted pulleys 31, 32 and 33 through which the riser stabilizing cables 34, 36 and 37 are guided. The respective tensioning cables 23 are provided with a positioning bracket 38 which fastens to the respective cable 23 by way of a series of radial clamping arms 39. Bracket 38 is preferably positioned substantially horizontally with respect to the position of ring 29. Each outstanding bracket 38 supports a pulley 41, which guides cable 34 and which extends inwardly toward riser 28. Thus, stabilizing cable 34 passes through pulley 41 and is fastened at its terminus to the fastening means 42 on the exterior of ring 29.

The other end of stabilizing cable 34 extends upwardly along riser side and to the platform deck 11. At the latter it is connected to a tension adjusting means such as the cable take-up drum 20 or the like.

Operationally, as riser 28 is subjected to a lateral displacement force due to water currents acting thereagainst, the displacing force will be detected at the platform 11 by any one of a number of sensor means known to and used by the industry. To compensate for such displacing tendencies, stabilizing cables 34, 36 and 37 are automatically adjusted to return the riser substantially to its desired vertical disposition. Alternatively said system will provide the riser with a predetermined degree of curvature such that the drilling operation can be continued safely.

As shown in FIG. 2, by proper adjustment of the respective radially arranged stabilizing cables 34, 36 and 37, the degree of curvature induced in riser 28 can be controlled. Said control is governed in accordance with the lateral displacement of platform 10 from a position above well head 22.

In the instance where riser 28 is subjected to a sudden or unexpected shock due to either underwater movement, or to a severe movement of platform 10, the respective riser stabilizing cables will adjust to such movement whereby to cushion the sudden stress on the riser as to minimize strain in the latter. The latter can be in the form of a reeling in or out operation. This is achieved primarily by the respective connections at bracket 39. Since the tensioning cables 23 are maintained in a substantially constant condition of tension, they will also function as a resilient member capable of absorbing the above noted shock to riser 28 when the latter is subjected to displacement.

The respective cables 23 will be subjected to some bending as a result of their shock absorbing function. However, this bending will be relatively uniform and will have a minimal effect on the disposition of platform 10.

Further, should the offsetting force against riser 28 become fixed, stabilizing cables 34, 36 and 37 can be altered to achieve a state of comparative stability.

Other modifications and variations of the invention as hereinbefore set forth may be made without departing from the spirit and scope thereof, and therefore, only such limitations should be imposed as are indicated in the appended claims.

I claim:

1. In a tension leg marine structure for an offshore body of water including a buoyant structure having a working deck, means to apply a buoyant force to the structure whereby to controllably regulate the floating disposition thereof in a body of water, anchor means at the floor of said body of water, tension cable means extending between said anchor means and said structure respectively, said tension cable means being adjustable by applying tension thereto for establishing the floating disposition of said marine structure in the water, an elongated riser extending between, and connected at its repective extremities to said structure and to a connector means disposed at the ocean floor, and a riser bracing system including; a riser tensioning cable having opposed ends, being operably connected to said riser and to said tension cable means respectively, one end of said riser tensioning cable extending upwardly to said structure's deck and being connected to a cable take-up mechanism, the latter being operable to adjust the force applied to said riser tensioning cable, whereby to controllably regulate the tension applied to said riser tensioning cable and thereby to adjust the disposition of said riser with respect to the disposition of said tension cable.

2. An apparatus as defined in claim 1, including means carried on said structure being operable to monitor the lateral displacement of said riser with respect to said structure.

3. In an apparatus as defined in claim 1, wherein a plurality of tension cables extending between said deck and said anchor means are being peripherally spaced about said structure.

4. In an apparatus as defined in claim 1, wherein said riser bracing system includes a collar removably carried on said riser and having means thereon to receive said riser tensioning cable.

5. In an apparatus as defined in claim 1, wherein said riser bracing system includes a plurality of riser tensioning cables extending between said riser and said tension cables, and being spaced along said riser.

* * * * *